US011156050B1

(12) United States Patent
Todd et al.

(10) Patent No.: US 11,156,050 B1
(45) Date of Patent: Oct. 26, 2021

(54) METHODS AND SYSTEMS FOR DEGRADING DOWNHOLE TOOLS CONTAINING MAGNESIUM

(71) Applicant: Magnesium Machine, LLC, Marlow, OK (US)

(72) Inventors: Brad Todd, Duncan, OK (US); Loren Swor, Duncan, OK (US)

(73) Assignee: Paramount Design LLC, Duncan, OK (US)

( * ) Notice: Subject to any disclaimer, the term of this patent is extended or adjusted under 35 U.S.C. 154(b) by 0 days.

(21) Appl. No.: 16/402,952

(22) Filed: May 3, 2019

Related U.S. Application Data

(60) Provisional application No. 62/667,042, filed on May 4, 2018.

(51) Int. Cl.

| | |
|---|---|
| ***E21B 29/02*** | (2006.01) |
| ***E21B 33/134*** | (2006.01) |
| ***C22C 23/04*** | (2006.01) |
| ***C22C 23/02*** | (2006.01) |

(52) U.S. Cl.
CPC ..... *E21B 29/02* (2013.01); *C22C 23/02* (2013.01); *C22C 23/04* (2013.01); *E21B 33/134* (2013.01)

(58) Field of Classification Search
CPC ..... E21B 29/02; E21B 33/134; E21B 33/12
See application file for complete search history.

(56) References Cited

U.S. PATENT DOCUMENTS

| | | | |
|---|---|---|---|
| 2,695,066 | A | 11/1954 | Ragan |
| 9,428,986 | B2 | 8/2016 | Hern et al. |
| 9,624,751 | B2 | 4/2017 | Hern et al. |
| 9,702,029 | B2 | 7/2017 | Fripp et al. |
| 2003/0164237 | A1 | 9/2003 | Butterfield |
| 2011/0048743 | A1 | 3/2011 | Stafford et al. |
| 2013/0240200 | A1 | 9/2013 | Frazier |
| 2014/0190705 | A1 | 7/2014 | Fripp et al. |
| 2015/0152709 | A1 | 6/2015 | Tough et al. |
| 2015/0159462 | A1 | 6/2015 | Cutler |
| 2015/0337618 | A1 | 11/2015 | Hern et al. |
| 2015/0337619 | A1 | 11/2015 | Hern et al. |
| 2016/0024619 | A1 | 1/2016 | Wilks et al. |
| 2016/0201425 | A1 | 7/2016 | Walton et al. |
| 2016/0201427 | A1 | 7/2016 | Fripp et al. |
| 2016/0201435 | A1 | 7/2016 | Fripp et al. |
| 2016/0230494 | A1 | 8/2016 | Fripp et al. |
| 2016/0265091 | A1 | 9/2016 | Walton et al. |
| 2018/0306027 | A1 | 10/2018 | Sherman et al. |
| 2018/0362415 | A1 | 12/2018 | Doud et al. |
| 2019/0032173 | A1 | 1/2019 | Sherman et al. |
| 2019/0112516 | A1 | 4/2019 | Sherman et al. |
| 2019/0186248 | A1 | 6/2019 | Sherman |

OTHER PUBLICATIONS

Terves Inc., "DataSheet: SmartCORE Frac Balls," retrieved on Dec. 20, 2019, retrieved from the Internet: < URL: http://www.tervesinc.com/media/DataSheet_Terves_SmartCore.pdf >.

Terves Inc., webpage "SmartCORE Dissolvable Chemical Carrier," retrieved on Dec. 20, 2019, retrieved from the Internet: < URL: https://www.tervesinc.com/products/dissolvables/smartcore/ >.

*Primary Examiner* — Kristyn A Hall
(74) *Attorney, Agent, or Firm* — Dunlap Codding, PC

(57) ABSTRACT

A downhole tool comprising magnesium is placed in a well bore in a subterranean formation for performance of a downhole operation. After performance of the downhole operation, rather than mechanically retrieving or removing the tool, at least a portion of the magnesium in the downhole tool is dissolved by contacting the downhole tool with an aqueous ammonium chloride solution.

19 Claims, 9 Drawing Sheets

METHODS AND SYSTEMS FOR DEGRADING DOWNHOLE TOOLS CONTAINING MAGNESIUM

CROSS REFERENCE TO RELATED APPLICATION/INCORPORATION BY REFERENCE STATEMENT

This application claims priority to U.S. Provisional Application 62/667,042 filed May 4, 2018, the entire contents of which are hereby expressly incorporated herein by reference.

BACKGROUND OF THE INVENTIVE CONCEPTS

1. Field of the Inventive Concepts

The present disclosure relates to methods and systems for degrading downhole tools used in the oil and gas industry and, more particularly, to methods for degrading downhole tools comprising magnesium.

2. Brief Description of Related Art

In the oil and gas industry, a wide variety of downhole tools are used within a wellbore in connection with producing hydrocarbons or reworking a well that extends into a hydrocarbon producing subterranean formation. For examples, some downhole tools, such as fracturing plugs (i.e., "frac" plugs), bridge plugs, and packers, may be used to seal a component against casing along a wellbore wall or to isolate one pressure zone of the formation from another.

After the production or reworking operation is complete, the downhole tool must be removed from the wellbore to allow production or other operations to proceed without being hindered by the presence of the downhole tool. Removal of the downhole tool(s) is traditionally accomplished by complex retrieval operations involving milling or drilling the downhole tool for mechanical retrieval. In order to facilitate such operations, downhole tools have traditionally been composed of drillable metal materials, such as cast iron, brass, or aluminum. These operations can be costly and time consuming, as they involve introducing a tool string (e.g., a mechanical connection to the surface) into the wellbore, milling or drilling out the downhole tool (e.g., breaking a seal), and mechanically retrieving the downhole tool or pieces thereof from the wellbore to bring to the surface.

In other situations, a magnesium alloy or specially doped magnesium alloy is utilized as a degradable downhole tool. The magnesium alloy composition is typically chosen to degrade by galvanic corrosion in the presence of an electrolyte. When the degradation of the magnesium alloy is sufficient to reduce the mechanical properties of the material to a point that the material can no longer maintain its integrity, the downhole tool falls apart or sloughs off.

The specialty magnesium alloys developed for such applications are expensive to produce and have few other uses. In addition, downhole tools made from such specialty magnesium alloys do not rapidly degrade at lower temperatures. What is needed is a system for degrading a downhole tool constructed of more common magnesium alloys using electrolyte or other solution compatible with oil and gas well bore operations, and wherein the rate of degradation can be sufficiently high at lower wellbore temperatures.

SUMMARY OF THE INVENTIVE CONCEPTS

The inventive concepts disclosed and claimed herein relate generally to methods and systems for degrading downhole tools used in the oil and gas industry. In one embodiment, a downhole tool is introduced into a subterranean formation, wherein the downhole tool comprises at least one component made of a magnesium alloy. A downhole operation is performed and at least a portion of the magnesium alloy in the subterranean formation is degraded by contacting the magnesium alloy with an aqueous ammonium chloride solution.

In another embodiment, a system includes a tool string extending into a wellbore in a subterranean formation, a downhole tool connected to the tool string and placed in the wellbore, and a well treatment apparatus. The downhole tool is made, at least in part, of a magnesium alloy. The well treatment apparatus is configured to provide a first fluid comprising an aqueous based ammonium chloride treatment fluid for degrading the magnesium alloy.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. Like reference numerals in the figures may represent and refer to the same or similar element or function. In the drawings.

DETAILED DESCRIPTION OF EXEMPLARY EMBODIMENTS

Figure 1:
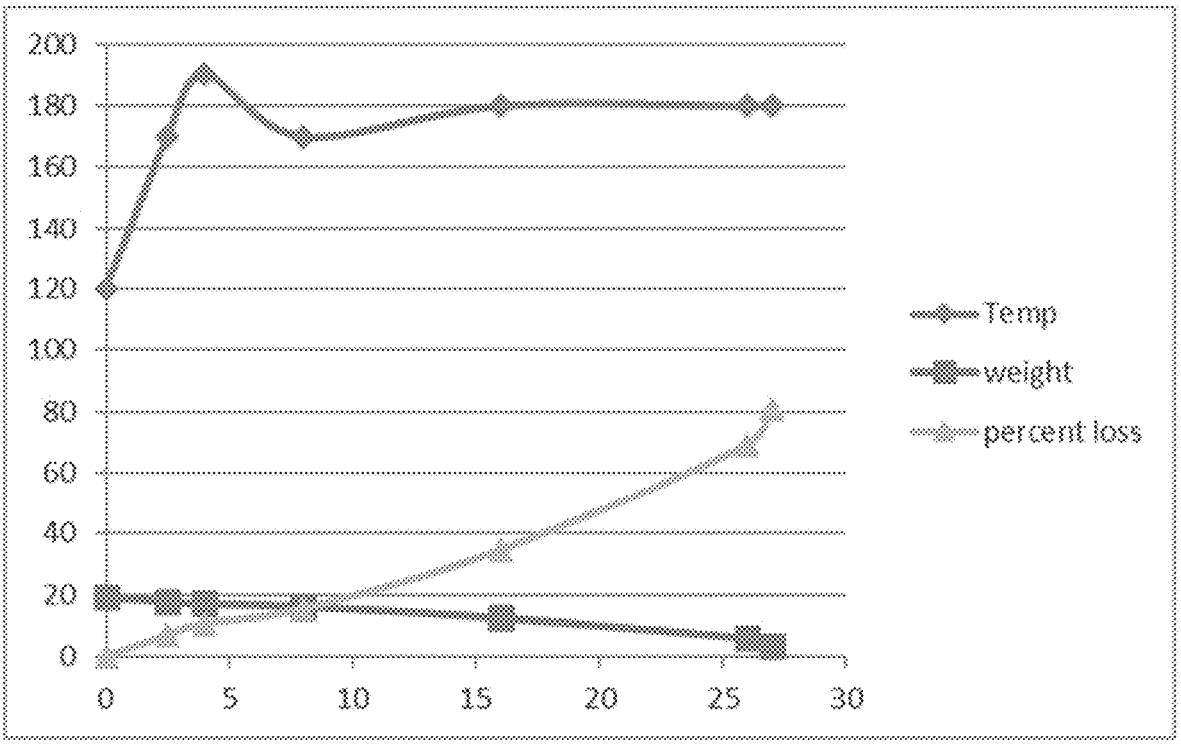
FIG. 1 is a graph showing the results over time for Example 1.

Before explaining at least one embodiment of the presently disclosed inventive concept(s) in detail, it is to be understood that the presently disclosed inventive concept(s) is not limited in its application to the details of construction and the arrangement of the components or steps or methodologies set forth in the following description or illustrated in the drawings. The presently disclosed inventive concept (s) is capable of other embodiments or of being practiced or carried out in various ways. Also, it is to be understood that the phraseology and terminology employed herein is for the purpose of description and should not be regarded as limiting.

Unless otherwise defined herein, technical terms used in connection with the presently disclosed inventive concept(s) shall have the meanings that are commonly understood by those of ordinary skill in the art. Further, unless otherwise required by context, singular terms shall include pluralities and plural terms shall include the singular.

All of the articles and/or methods disclosed herein can be made and executed without undue experimentation in light of the present disclosure. While the articles and methods of the presently disclosed inventive concept(s) have been described in terms of preferred embodiments, it will be apparent to those of skill in the art that variations may be applied to the articles and/or methods and in the steps or in the sequence of steps of the method described herein without departing from the concept, spirit, and scope of the presently disclosed inventive concept(s). All such similar substitutes and modifications apparent to those skilled in the art are deemed to be within the spirit, scope, and concept of the presently disclosed inventive concept(s).

As utilized in accordance with the present disclosure, the following terms, unless otherwise indicated, shall be understood to have the following meanings:

The use of the word "a" or "an" when used in conjunction with the term "comprising" in the claims and/or the specification may mean "one", but it is also consistent with the meaning of "one or more," "at least one," and "one or more than one." The use of the term "or" in the claims is used to mean "and/or" unless explicitly indicated to refer to alternatives only or that the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects. For example, but not by way of limitation, when the term "about" is utilized, the designated value may vary by plus or minus twelve percent, or eleven percent, or ten percent, or nine percent, or eight percent, or seven percent, or six percent, or five percent, or four percent, or three percent, or two percent, or one percent. The use of the term "at least one of X, Y, and Z" will be understood to include X alone, Y alone, and Z alone, as well as any combination of X, Y, and Z. The use of ordinal number terminology (i.e., "first," "second," "third," "fourth," etc.) is solely for the purpose of differentiating between two or more items and is not meant to imply any sequence or order or importance to one item over another or any order of addition, for example.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

As used herein, the term "substantially" means that the subsequently described event or circumstance completely occurs or that the subsequently described event or circumstance occurs to a great extent or degree. For example, when associated with a particular event or circumstance, the term "substantially" means that the subsequently described event or circumstance occurs at least 80% of the time, or at least 85% of the time, or at least 90% of the time, or at least 95% of the time. The term "substantially adjacent" may mean that two items are 100% adjacent to one another, or that the two items are within close proximity to one another but not 100% adjacent to one another, or that a portion of one of the two items is not 100% adjacent to the other item but is within close proximity to the other item.

The term "associate" as used herein will be understood to refer to the direct or indirect connection of two or more items.

As discussed above, some methods and systems for removal of the downhole tool(s) are costly due to the complex retrieval methods required. One proposed solution to this problem has been to form the tool from a material that will dissolve or corrode under the conditions in the well or borehole, requiring that the corrodible tool dissolves at a rate which allows it to remain useable for the time period during which it is required to perform its function, but then corrodes or dissolves afterwards.

As used herein, the term "degradable" and all of its grammatical variants (e.g., "degrade," "degradation," "degrading," and the like) refer to the dissolution or chemical conversion of solid materials such that a reduced structural integrity results. In complete degradation, structural shape is lost.

The term "metal" as used herein will be understood to include metal alloys.

Turning now to the presently disclosed inventive concept(s), certain embodiments thereof are directed to a method and system for dissolving downhole tools. Certain other embodiments of the presently disclosed inventive concept(s) are directed to methods of treating a subterranean wellbore.

In one embodiment, a downhole tool comprising magnesium is introduced into a subterranean formation. After performance of a downhole operation, at least a portion of the downhole tool comprising magnesium is degraded by contacting the downhole tool with an aqueous ammonium halide solution.

It was discovered that magnesium and magnesium alloys degrade rapidly in an aqueous ammonium halide solution. This is surprising because the same magnesium and magnesium alloys typically do not dissolve rapidly in acids, brines, or caustic solutions. In fact, doping of magnesium alloys has been developed, and continues to be developed, to provide the necessary degradation rate in brine solutions such as sodium chloride and calcium chloride. While doping increases the degradation rate compared to undoped magnesium alloy, the doping can be expensive and may adversely affect the mechanical properties and fabrication characteristics. Thus, the discovery that common magnesium alloys can be rapidly degraded with ammonium halide solutions can provide significant cost savings and performance enhancements.

The downhole tool comprising magnesium can include multiple structural components, wherein one or more of the components are composed of magnesium or magnesium alloy. The one or more components of the downhole tool may have different degradation rates. For example, in one embodiment, a downhole tool may comprise at least two components, one made of a magnesium alloy and the other made of a ceramic. It is not necessary that each component of the downhole tool be composed of magnesium or a magnesium alloy, only that the downhole tool is capable of sufficient degradation in an aqueous ammonium halide solution to be sufficiently removed from a particular downhole operation.

The magnesium alloy forming at least one of the components of a downhole tool may be any magnesium alloy including, but not limited to, an AZ magnesium alloy, a ZK magnesium alloy, an AM magnesium alloy, a WE magnesium alloy, and the like. As understood by those in the art, AZ magnesium alloy is an alloy comprising at least aluminum, zinc, and magnesium; ZK magnesium alloy is an alloy comprising at least zinc, zirconium, and magnesium; AM magnesium is an alloy comprising at least aluminum, manganese, and magnesium; AE magnesium alloy is an alloy comprising at least aluminum, a rare earth metal, and magnesium; and WE magnesium alloy is an alloy comprising at least yttrium, a rare earth metal, and magnesium.

Although a number of magnesium alloys and doped magnesium alloys have been developed to galvanically corrode in the presence of an electrolyte, many magnesium alloys are more corrosion resistant. For example, magnesium (Mg)-based alloys containing 2-10 wt % aluminum (Al) with trace additions of zinc (Zn) and manganese (Mn), are widely available at moderate cost and with moderate corrosion resistance and improved mechanical properties. While doped magnesium alloys having high corrosion rates can be utilized in the presently disclosed methods and systems, in one embodiment the magnesium alloy is a "standard" magnesium metal or alloy. A "standard" magnesium metal or alloy is defined herein as a magnesium metal or magnesium alloy having a corrosion rate of less than about 200 mils per year (mpy) according to ASTM B 117 salt-spray test.

In one embodiment, the downhole tool comprises a magnesium alloy having a corrosion rate of less than about 100 mpy according to ASTM B 117 salt-spray test. In another embodiment, the downhole tool comprises a magnesium alloy having a corrosion rate of less than about 50 mpy according to ASTM B 117 salt-spray test.

Suitable examples of magnesium alloys include, but are not limited to, an AZ magnesium alloy comprising about 80% to about 98% magnesium, about 1% to about 13% aluminum, and about 0.1% to about 5% zinc, each by weight of the AZ magnesium alloy; a ZK magnesium alloy comprising about 80% to about 98% magnesium, about 1% to about 12% zinc, and about 0.01% to about 5% zirconium, each by weight of the ZK magnesium alloy; an AM magnesium alloy comprising about 80% to about 97% magnesium, about 2% to about 10% aluminum, and about 0.1% to about 4% manganese, each by weight of the AM magnesium alloy.

Examples of suitable downhole tools may include wellbore isolation devices such as a frac plug, a frac ball, a setting ball, a bridge plug, a wellbore packer, a wiper plug, a cement plug, a base pipe plug, a sand screen plug, an inflow control device (ICD) plug, an autonomous ICD plug, a tubing section, a tubing string, and any combination thereof. In some embodiments, the downhole tool may be a completion tool, a drill tool, a testing tool, a slickline tool, a wireline tool, an autonomous tool, a tubing conveyed perforating tool, and any combination thereof. The downhole tool may have one or more components made of a standard magnesium alloy including, but not limited to, the mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block (e.g., to prevent sliding sleeves from translating), a logging tool, a housing, a release mechanism, a pumpdown tool, an inflow control device plug, an autonomous inflow control device plug, a coupling, a connector, a support, an enclosure, a cage, a slip body, a tapered shoe, or any other component thereof.

The ammonium halide can comprise ammonium fluoride, ammonium chloride, ammonium bromide, ammonium iodide, and combinations thereof.

In one embodiment the ammonium halide comprises ammonium chloride.

In one embodiment, the aqueous ammonium halide solution has an ammonium halide concentration in a range of from about 1% to about 25%, or in a range of from about 1% to about 15%, or in a range of from about 1% to about 10%.

In one embodiment, the aqueous ammonium halide solution has a temperature above about 200° F. upon contact with the downhole tool comprising magnesium.

In one embodiment, the aqueous ammonium halide solution has a temperature below about 200° F. upon contact with the downhole tool comprising magnesium In one embodiment, the aqueous ammonium halide solution has a temperature below about 150° F. upon contact with the downhole tool comprising magnesium.

In one embodiment, the aqueous ammonium halide solution has a temperature below about 100° F. upon contact with the downhole tool comprising magnesium.

In the following examples, specific compositions and test conditions are described. However, the present inventive concept(s) is not be limited in its application to the specific experimentation, results and laboratory procedures. Rather, the Examples are simply provided as one of various embodiments and are meant to be exemplary, not exhaustive.

COMPARATIVE EXAMPLES

An aqueous solution of 1 wt % sodium chloride was heated to 180° F. A magnesium alloy ZK60 test part was added to the solution and the part weight was monitored over time. The ZK60 used in the Examples had a nominal composition of Mg with 6 wt % Zn and 0.5 wt % Zr.

Negligible weight loss of the ZK60 was observed over a 2-day period. The test was repeated using 5 wt % sodium chloride at 100° F. Again, negligible weight loss of the part was observed. Similar test results were obtained substituting AZ80 for the ZK60 and substituting magnesium chloride for the sodium chloride.

Example 1

An aqueous solution of 1 wt % ammonium chloride was heated to 180° F. A magnesium alloy MM3 (nearly identical to ZK60 but including nickel) test part weighing 19.22 grams was added to 2.8 pounds of the heated 1% ammonium chloride solution. The solution temperature and part weight were monitored over time. The results are shown in Table 1-1 below.

TABLE 1-1

| Results of 180° F. Mg Decomposition | | | |
|---|---|---|---|
| Hours | Temp, ° F. | Weight, g | Percent Loss |
| 0 | 120 | 19.22 | 0 |
| 2.5 | 170 | 17.9 | 6.867845994 |
| 4 | 190 | 17.17 | 10.66597294 |
| 8 | 170 | 16.26 | 15.40062435 |
| 16 | 180 | 12.58 | 34.54734651 |
| 26 | 180 | 5.9 | 69.30280957 |
| 27 | 180 | 3.7 | 80.74921956 |

One can see that after 27 hours the magnesium alloy was nearly completely dissolved. The results are shown graphically in FIG. 1.

Example 2

To test the decomposition efficiency at cooler temperatures, an aqueous solution of 5 wt % ammonium chloride was used. A magnesium alloy MM3 (nearly identical to ZK60 but including nickel) test part weighing 28.58 grams was added to 2.8 pounds of the 5% ammonium chloride solution. The solution temperature and part weight were monitored over time. The results are shown in Table 2-1 below.

TABLE 2-1

| Results of Ambient Temperature Mg Decomposition | | | |
|---|---|---|---|
| Hours | Temp, ° F. | Weight, g | Percent Loss |
| 0 | 120 | 28.58 | 0 |
| 2.5 | 100 | 16.96 | 11.7585848 |
| 4 | 100 | 15.77 | 17.950052 |
| 8 | 100 | 13.3 | 30.8012487 |
| 16 | 90 | 4.69 | 75.5983351 |

Figure 2:
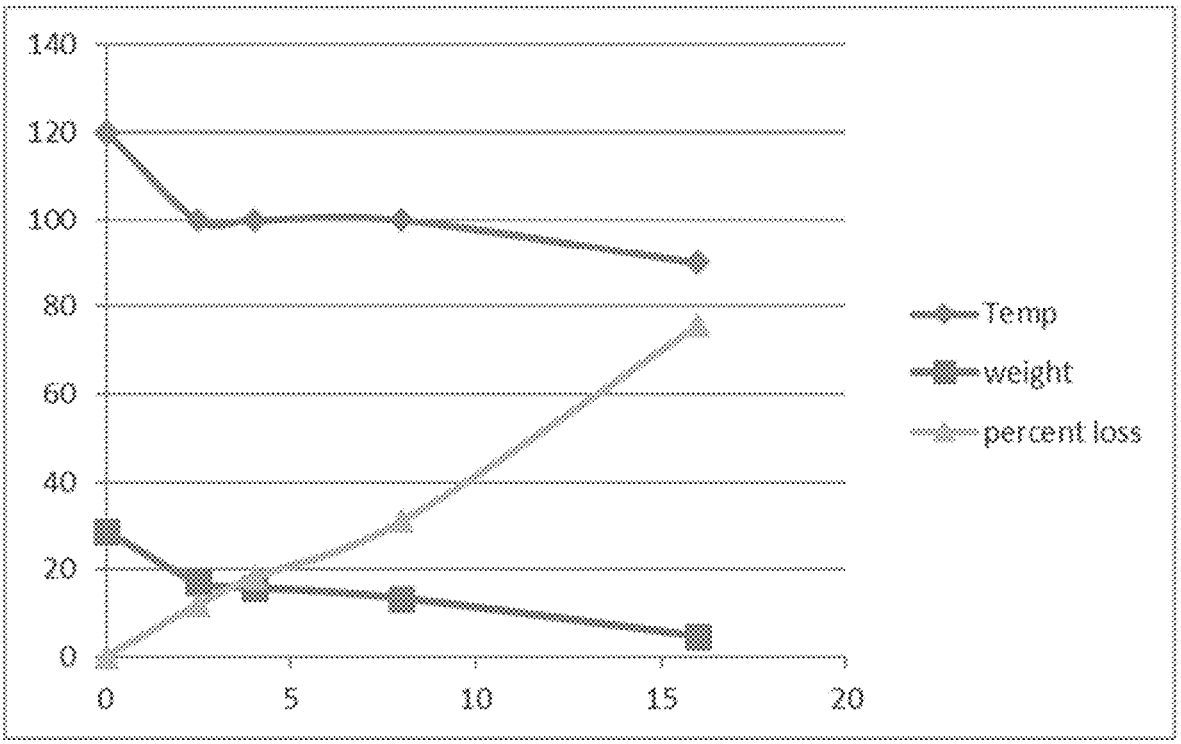
FIG. 2 is a graph showing the results over time for Example 2.

The magnesium alloy was significantly degraded after only 2.5 hours and nearly completely dissolved after 16 hours. The results are shown graphically in FIG. 2.

Example 3

A large surface area ZK60 puck was immersed in 3 wt % ammonium chloride and heated to 180° F. The puck sludged so rapidly that the test was stopped. The puck was cut in half and the test repeated. The half-puck weighed 409 g was immersed in 2.8 lbs of 5 wt % ammonium chloride and heated to 180° F. The rate of loss was quite high at 73 mg/crri$^2$/hr and sludging again occurred so fast the test was stopped after 6 hours. Data are shown below in Table 3-1.

TABLE 3-1

| Result of Mg Puck Dissolution | | | | |
|---|---|---|---|---|
| Hours | Temp, ° F. | Weight, g | percent loss | Area, cm$^2$ |
| 0 | 130 | 409 | 0 | 245 |
| 1 | 180 | 395 | 3 | |
| 6 | 180 | 305 | 25 | |

Figure 3:
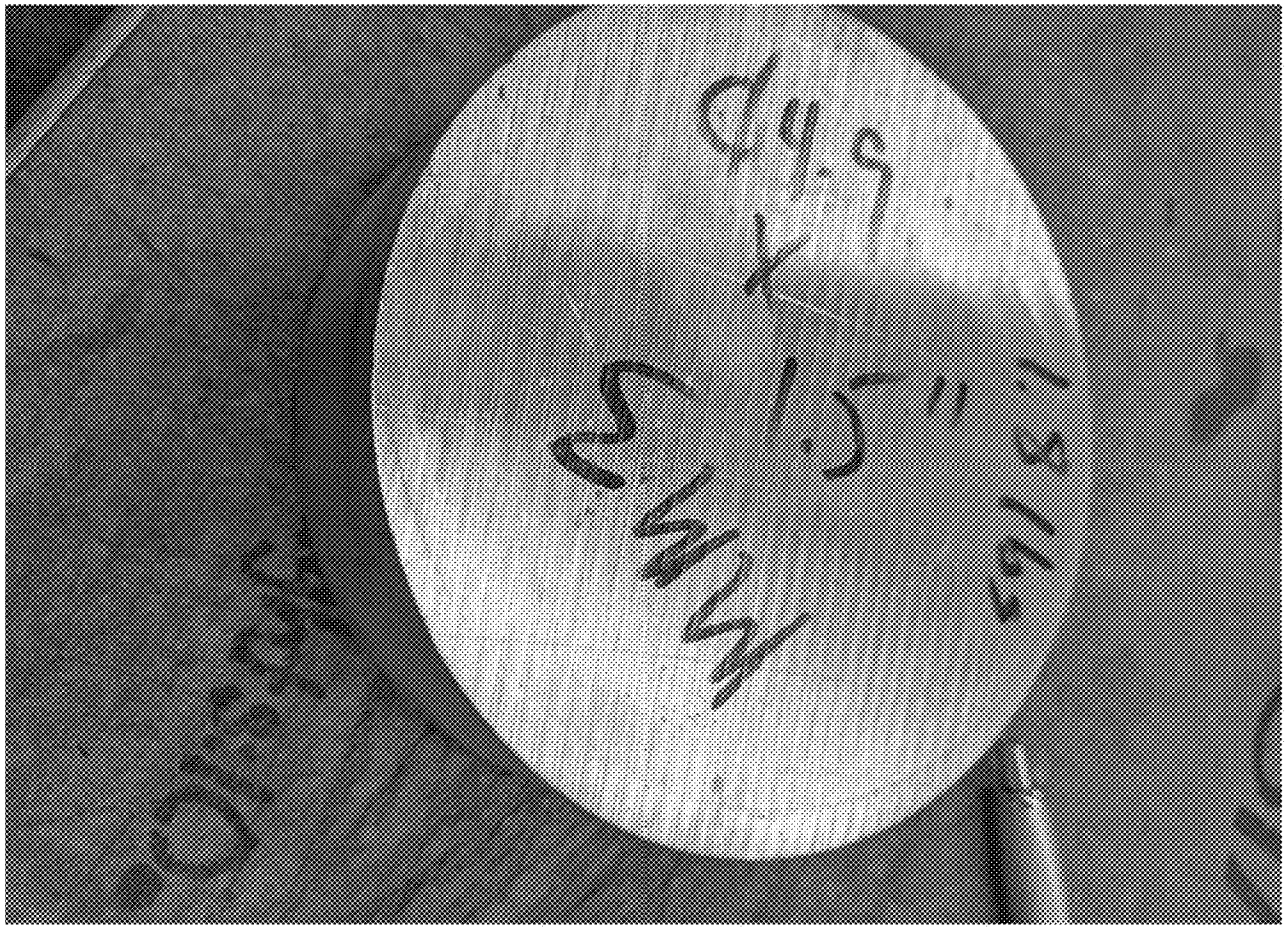
FIG. 3 is a photograph of the puck used in Example 3.
Figure 4:
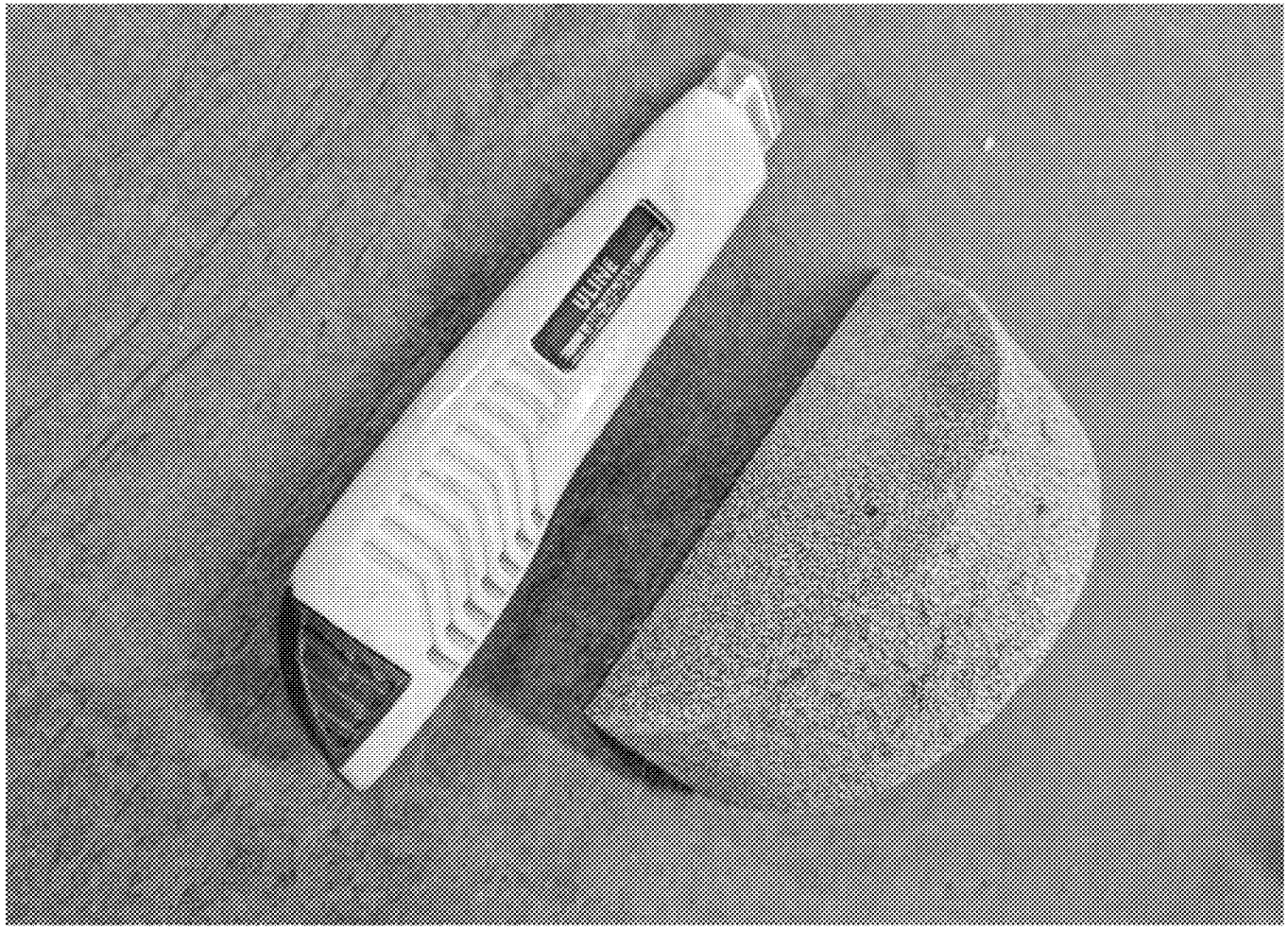
FIG. 4 is a photograph of the degraded half-puck from Example 3.
Figure 5:
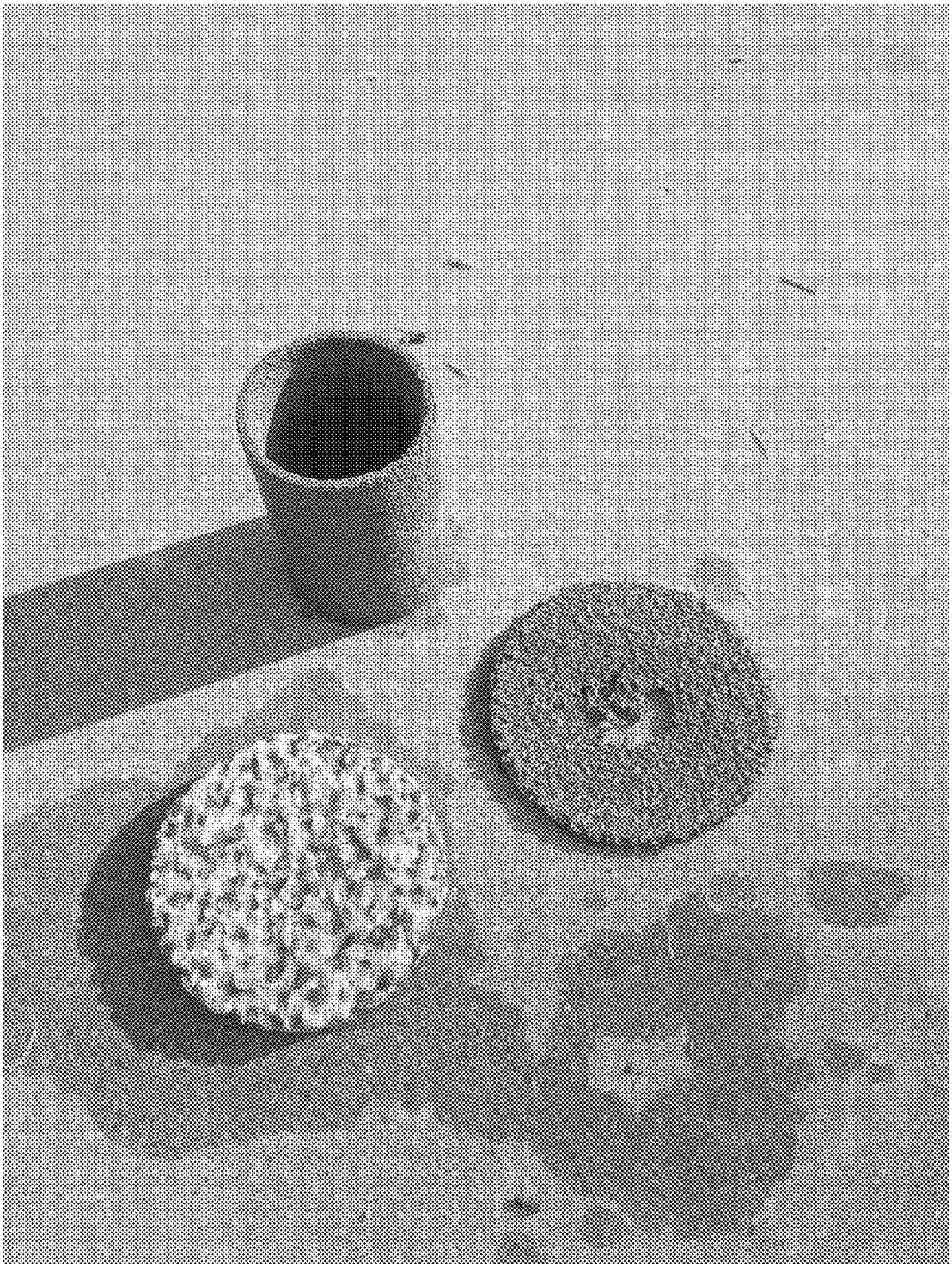
FIG. 5 is a photograph of two rare earth-doped magnesium alloy parts degraded for 20 hours at ambient temperature and pressure in 3 wt % ammonium chloride solution.
Figure 6:
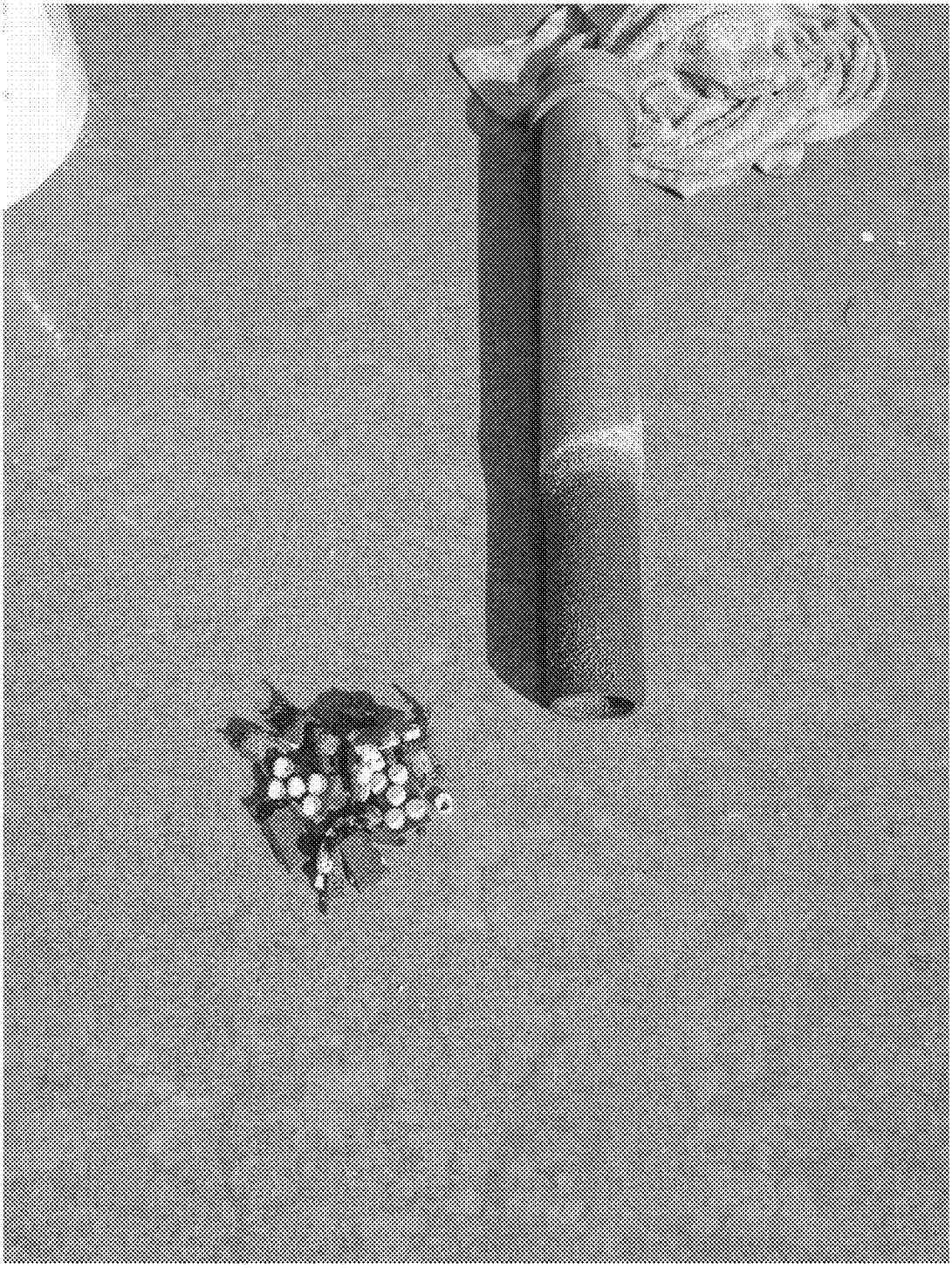
FIG. 6 is a photograph of a ZK60 slip and mandrel after 40 hours of exposure to 3 wt % ammonium chloride solution at ambient temperature and pressure.
Figure 7:
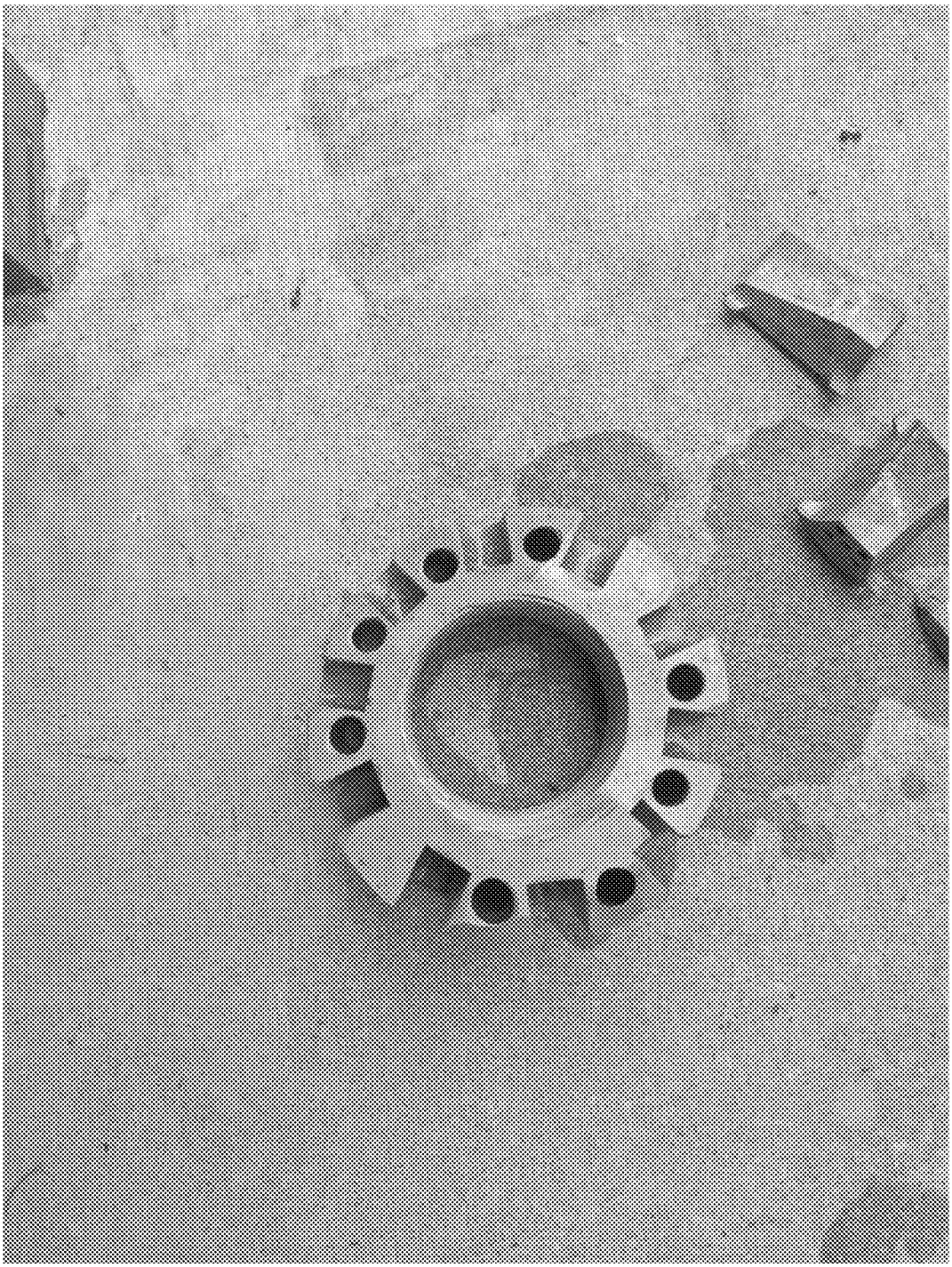
FIGS. 7 and 8 show a mule shoe, slip and mandrel after treating in ammonium chloride solution.
Figure 8:
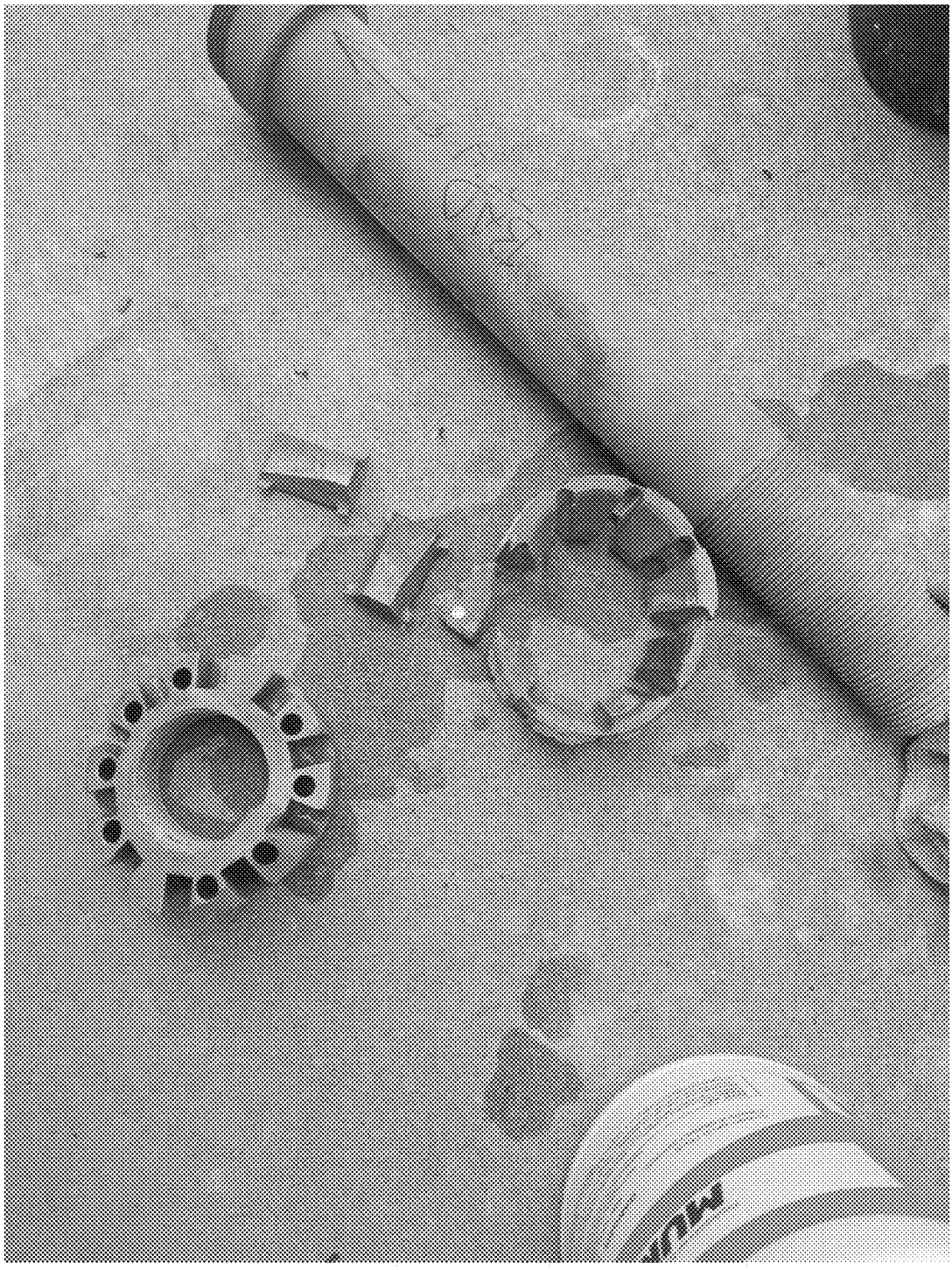

A photograph of the puck prior to testing is shown in FIG. 3. After 6 hours in the ammonium chloride solution at 180° C., the half-puck is quite degraded as shown in the photograph of FIG. 4. Similarly, FIG. 5 is a photograph of two rare earth-doped magnesium alloy parts degraded for 20 hours at ambient temperature in 3 wt % ammonium chloride solution. FIG. 6 is a photograph of a ZK60 slip and mandrel after 40 hours of exposure to ambient ammonium chloride solution. Additional photographs in FIGS. 7-8 show a mule shoe, slip and mandrel after treating in ammonium chloride solution.

Example 4

After decomposition of a magnesium alloy part as described in Example 2, an unknown solid remained. A sample of the solid along with a sample of the remaining solution were analyzed to determine their composition. The composition of the final solution and the unknown precipitate material were analyzed by inductively coupled plasma analysis (ICP) and x-ray diffraction (XRD). ICP showed elevated levels of magnesium and chlorides in the remaining aqueous solution. Results are shown in Table 4-1 below.

TABLE 4-1

| Solution after Magnesium Part Decomposition | | | | | | | | | | | |
|---|---|---|---|---|---|---|---|---|---|---|---|
| Sample | B mg/l | Ba mg/l | Ca mg/l | Fe mg/l | K mg/l | Mg mg/l | Mn mg/l | Na mg/l | Sr mg/l | Zn mg/l | Chlorides mg/l |
| Brine | 0.221 | <dl | 19.4 | <dl | 8.22 | 3963 | <dl | 59.0 | 1.08 | 82.6 | 22993.9 |

XRD showed the solid sample was 94% brucite (magnesium hydroxide) and 6% magnesium chloride.

Example 5

Equal weight samples (153 g) of ZK60 and a magnesium alloy doped with rare earth metals to provide rapid dissolution (exact composition is proprietary) were submerged in one of 3 wt % KCl, 3 wt % NaCl and 3 wt % $NH_4Cl$ solutions heated to and maintained at 190° F. The weight of solid remaining undissolved was measured every hour. The results are shown in Table 5-1 below.

TABLE 5-1

Results of Doped and Undoped Mg Decomposition in Varying Chlorides

| | Salt | | | | | |
|---|---|---|---|---|---|---|
| | KCl 3% | NaCl 3% | $NH_4Cl$ 3% | KCl 3% | NaCl 3% | $NH_4Cl$ 3% |
| | Temp | | | | | |
| | 190° F. | 190° F. | 190° F. | 190° F. | 190° F. | 190° F. |
| | Alloy | | | | | |
| Hours | ZK60 | ZK60 | ZK60 | MD | MD | MD |
| 0 | 153 | 152 | 153 | 153 | 153 | 154 |
| 1 | 153 | 152 | 135 | 150 | 149 | 147 |
| 2 | 153 | 152 | 108 | 138 | 135 | 137 |
| 3 | 153 | 152 | 93 | 126 | 123 | 126 |
| 4 | 153 | 152 | 79 | 115 | 113 | 115 |
| 5 | 153 | 152 | 65 | 104 | 98 | 108 |
| 6 | 153 | 152 | 53 | 92 | 85 | 99 |
| 7 | 153 | 152 | 38 | 75 | 64 | 92 |
| 8 | 153 | 152 | 23 | 63 | 50 | 85 |
| 9 | | | | 49 | 39 | 80 |
| 10 | | | | 39 | 27 | 74 |
| 11 | | | | 27 | 15 | 69 |
| 12 | | | | 19 | 10 | 65 |

Figure 9:
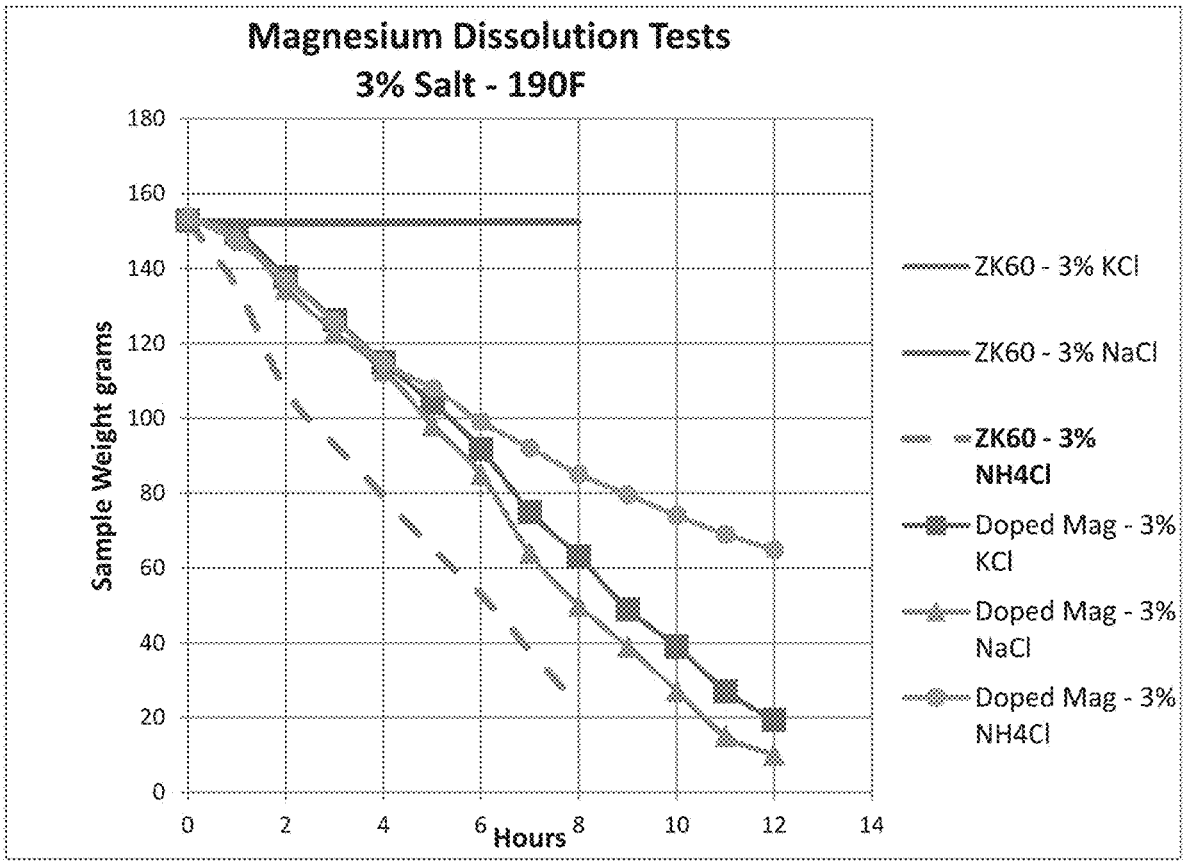
FIG. 9 graphically shows dissolution results of various magnesium alloys in sodium, potassium and ammonium salt solutions.

Surprisingly, the doped magnesium dissolved more rapidly in potassium chloride and sodium chloride than it did in the ammonium chloride. Even more surprising was that the undoped ZK60 was untouched in both potassium chloride and in sodium chloride. There was zero dissolution of the ZK60 in these salts, yet near complete dissolution in ammonium chloride. The results are illustrated in FIG. 9.

Example 6

The test described in Example 1 above was repeated using solutions of ammonium bromide and ammonium iodide. While the magnesium alloy part degraded with both solutions, the very rapid dissolution observed with ammonium chloride did not occur.

Thus, in accordance with the presently disclosed inventive concept(s), there have been provided methods of degrading downhole tools, as well as systems utilizing the same, that fully satisfy the advantages set forth herein above. Although the presently disclosed inventive concept(s) has been described in conjunction with the specific language set forth herein above, it is evident that many alternatives, modifications, and variations will be apparent to those skilled in the art. Accordingly, it is intended to embrace all such alternatives, modifications, and variations that fall within the spirit and broad scope of the presently disclosed inventive concept(s). Changes may be made in the construction and the operation of the various components, elements, and assemblies described herein, as well as in the steps or the sequence of steps of the methods described herein, without departing from the spirit and scope of the presently disclosed inventive concept(s).

What is claimed is:

1. A method comprising:

introducing a downhole tool into a subterranean formation, wherein the downhole tool comprises at least one component made of a standard undoped magnesium alloy having a corrosion rate of less than 200 mpy according to ASTM B 117 salt-spray test;

performing a downhole operation; and degrading at least a portion of the standard undoped magnesium alloy in the subterranean formation by contacting the standard undoped magnesium alloy with an aqueous ammonium halide solution.

2. The method of claim 1, wherein the standard undoped magnesium alloy is selected from the group consisting of: an AZ magnesium alloy comprising about 80% to about 98% magnesium, about 1% to about 13% aluminum, and about 0.1% to about 5% zinc, each by weight of the AZ magnesium alloy; a ZK magnesium alloy comprising about 80% to about 98% magnesium, about 1% to about 12% zinc, and about 0.01% to about 5% zirconium, each by weight of the ZK magnesium alloy; an AM magnesium alloy comprising about 80% to about 97% magnesium, about 2% to about 10% aluminum, and about 0.1% to about 4% manganese, each by weight of the AM magnesium alloy; and any combination thereof.

3. The method of claim 1, wherein the standard undoped magnesium alloy has a corrosion rate of less than 100 mpy according to ASTM B 117 salt-spray test.

4. The method of claim 1, wherein the standard undoped magnesium alloy has a corrosion rate of less than 50 mpy according to ASTM B 117 salt-spray test.

5. The method of claim 1, wherein the aqueous ammonium halide solution comprises ammonium chloride.

6. The method of claim 1, wherein the aqueous ammonium halide solution comprises from about 1 wt % to about 25 wt % ammonium halide.

7. The method of claim 1, wherein the aqueous ammonium halide solution comprises from about 1 wt % to about 15 wt % ammonium halide.

8. The method of claim 1, wherein the aqueous ammonium halide solution has a temperature between about 100° F. and about 180° F.

9. A system comprising: a tool string extending into a wellbore in a subterranean formation; a downhole tool connected to the tool string and placed in the wellbore, the downhole tool comprising a standard undoped magnesium alloy; and a well treatment apparatus configured to provide a first fluid comprising an aqueous based ammonium halide treatment fluid for degrading the standard undoped magnesium alloy.

10. The system of claim 9, wherein the downhole tool is a wellbore isolation device, the wellbore isolation device being a frac plug or a frac ball.

11. The system of claim 9, wherein the downhole tool is selected from the group consisting of a mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block, a logging tool, a housing, a release mechanism, a pumpdown tool, an inflow control device plug, an autonomous inflow control device plug, a coupling, a connector, a support, an enclosure, a cage, a slip body, a tapered shoe, and any combination thereof.

12. The system of claim 9, wherein the aqueous based ammonium halide treatment fluid comprises ammonium chloride.

13. The system of claim 9, wherein the aqueous based ammonium halide treatment fluid has an ammonium halide concentration in a range of from about 1 wt % to about 25 wt %.

14. The system of claim 9, wherein the aqueous based ammonium halide treatment fluid has an ammonium halide concentration in a range of from about 1 wt % to about 15 wt %.

15. The system of claim 9, wherein the aqueous based ammonium halide treatment fluid has a temperature between about 100° F. and about 180° F.

16. A downhole tool comprising a standard undoped magnesium alloy degradable in an aqueous ammonium halide solution at a temperature between about 100° F. and about 180° F.

17. The downhole tool of claim 16, wherein the ammonium halide comprises ammonium chloride.

18. The downhole tool of claim 16, wherein the standard undoped magnesium alloy has a degradation rate of at least about 70 $mg/cm^2/hr$ in an aqueous ammonium chloride solution.

19. The downhole tool of claim 16, wherein the standard undoped magnesium alloy has a corrosion rate of less than about 200 mils per year (mpy) according to ASTM B 117 salt-spray test.

* * * * *